United States Patent [19]

Sanvito

[11] 4,367,687

[45] Jan. 11, 1983

[54] WORKTABLE FOR SEWING MACHINES

[75] Inventor: Roberto Sanvito, Milan, Italy

[73] Assignee: Rockwell-Rimoldi, S.p.A., Italy

[21] Appl. No.: 268,606

[22] Filed: May 29, 1981

[30] Foreign Application Priority Data

Jun. 12, 1980 [IT] Italy ..... 22033/80[U]

[51] Int. Cl.[3] ..... D05B 75/00; A47B 29/00

[52] U.S. Cl. ..... 112/217.1; 108/17

[58] Field of Search ..... 112/217.1, 63, 258, 112/260; 312/24, 21, 30, 22, 23; 108/12, 17, 92

[56] References Cited

U.S. PATENT DOCUMENTS 3,570,431 3/1971 Fresard ..... 112/63
3,726,237 4/1973 Devey et al. ..... 112/217.1
3,946,682 3/1976 Cowdrey et al. ..... 112/217.1
4,044,700 8/1977 Aeschliman ..... 112/217.1
4,312,549 1/1982 Ravenelle ..... 112/217.1 X

*Primary Examiner*—H. Hampton Hunter

[57] ABSTRACT

A worktable for sewing units having sewing machines with free-arm type bases mounted on a support bench. The worktable is operatively connected to the support bench and includes a recess with a configuration conforming to the shape of the sewing machine base. By means of a selectively controlled lifting device, the worktable can be moved to and from operative association with the base as desired to accommodate either tubular seaming or seaming on flat workpieces which require a larger supporting surface.

3 Claims, 3 Drawing Figures

WORKTABLE FOR SEWING MACHINES

BACKGROUND OF THE INVENTION

The present invention pertains to a workable for a sewing machine unit and more particularly, for units having sewing machines with a free arm type base in which said worktable is selectively located in a fixed and predetermined position relative to said base.

Worktables are commonly utilized with those machines which are adapted to accommodate tubular seaming, i.e., seams which require the article to be stitched to extend around the base of the machine. These worktables serve to support the articles to be sewn in the most desirable position relative to the base of the machine, in order to grip and facilitate manual manipulation of the articles before and after sewing, without greatly hindering the operator.

For this reason, the worktables are usually located in a fixed position lower than the base of the machine in the most convenient location spaced from said base so as not to interfere with the operator's movements.

Each worktable has a supporting bench, the height of which can be manually adjusted so as to locate said worktable at the appropriate distance from the base of the machine while taking into consideration and allowing for the thickness of the articles to be sewn and the minimum free space required for the sewing operations.

The space between the worktable and the bases increases, however, as the articles are consecutively sewn and consequently the distance between the operator and the article which she has to manipulate for each sewing operation also increases. If the repetitive nature of this condition is considered, it is obvious that it creates an annoyance and discomfort for the operator through a progressive change in the manner of manually manipulating the articles or workpieces and has a very definite effect on the working efficiency of said operator.

As is well known, the worksurfaces for sewing machines with free arm type bases are relatively narrow due to the configuration of the bases which are generally cylindrical. Such worksurfaces possess certain disadvantages for they are not adapted to adequately perform sewing operations on flat workpieces in which a large portion of the area of such workpieces are required to be supported during actual sewing. With sewing machines of the planar base type, it is common practice to increase the area of the worksurface by attaching an auxiliary surface in operative association with the base by means of conventional clamps. However, to increase the worksurface area of sewing machines with free arm type bases involves considerably more time and effort for they require specifically shaped elements and special attaching elements for mounting them in operative association with the base.

An object of the present invention is to provide a worktable for sewing machines having free arm type bases which can be utilized to satisfactorily accommodate flat workpieces that need to be supported over a large portion of their area during seaming and in particular, to a worktable for such machines that will facilitate the manual operations associated with tubular sewing.

SUMMARY OF THE INVENTION

The worktable according to the invention defines a flat planar surface mounted on a lifting mechanism which is operatively connected to an actuating device that is adapted to be controlled by the machine operator and can be gradually raised during operation of the machine so as to facilitate the operations of tubular sewing. Additionally, the top planar surface of the worktable is provided with a longitudinally extending recess having a configuration conforming to the shape of the free arm type base and when raised to its maximum height, its planar surface is substantially aligned with the upper surface of said base and the edges of the recess are located in close proximity with the sides and end of the latter.

The advantages of a worktable according to the invention are obvious for it provides a means for moving a plurality of superposed workpieces, that are to be sewn consecutively, upwardly so that the distance the operator must reach to manipulate each workpiece to sewing position remains constant, or in other words, the stack of workpieces are gradually raised so as to position the top workpiece in the same position from which the operator removed the previous one.

A further advantage is the simplicity with which the worksurface of a sewing machine can be enlarged without adding independent auxiliary surfaces.

These and other objects of the present invention will become more fully apparent by reference to the appended claims and as the following detailed description proceeds in reference to the figures of drawing wherein:

DESCRIPTION OF THE PREFERRED EMBODIMENT

Figure 1:
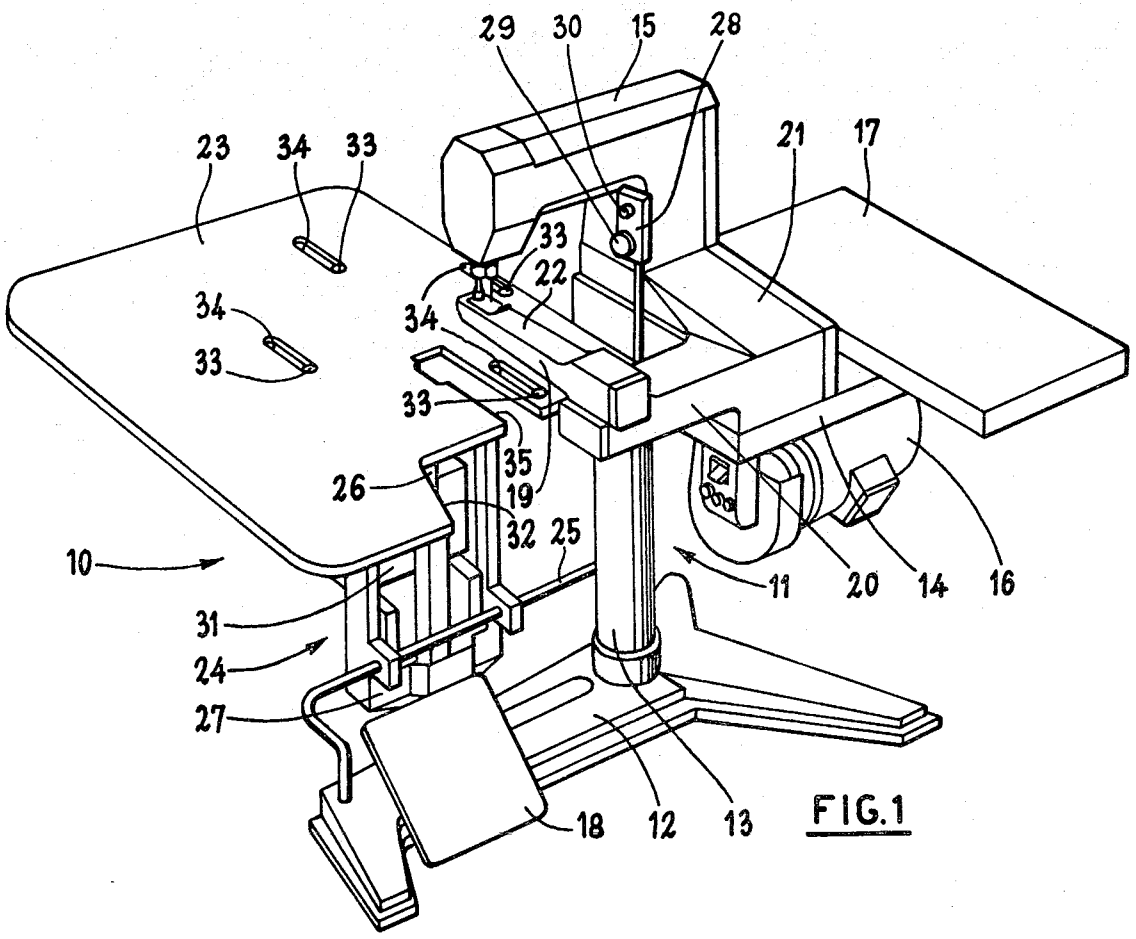
FIG. 1 is a perspective view of a sewing machine and its supporting bench showing the worktable according to the invention applied thereto.

Referring now to FIG. 1, the worktable according to the invention is identified generally by numeral 10 and is operatively connected to a support bench of the column type which is depicted generally by numeral 11. This support bench 11 includes a base 12, a vertically extending column 13 having a support frame 14 mounted on its upper end which is adapted to support a sewing machine 15. The sewing machine's source of power is an electric motor 16 mounted on the underside of the support frame 14 with a portion of the upper surface of the latter serving to carry a conventional auxiliary support surface 17. The bench 11 also includes a foot control pedal 18 for selectively starting and stopping the sewing machine. The sewing machine 15 is of the type having a free arm base 19 which is commonly referred to as feed-off-the-arm type wherein the base is displaced relative to the bases of conventional sewing machines. Intermediate the base 19 and the main frame of the sewing machine, housings 20 and 21 are provided which serve to suppport said base and house the driving elements for actuating the lower stitching instrumentalities.

It should be understood that the worktable according to the invention could be formed to operatively cooperate with other types of bases, i.e., it could extend parallel to the frame of the machine as is the case with the majority of known sewing machines.

Figure 3:
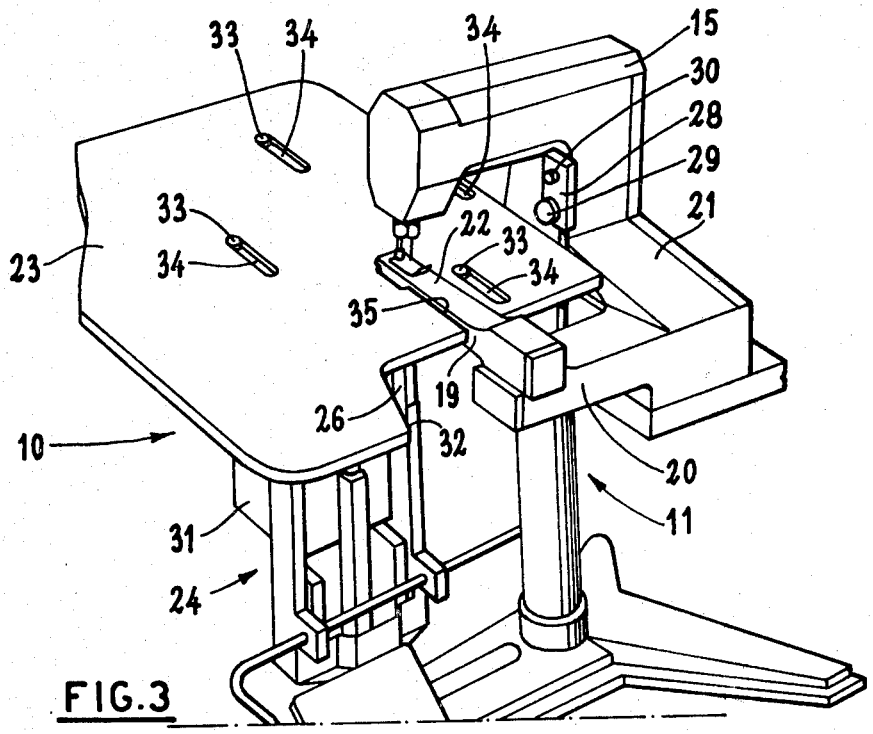
FIG. 3 is a perspective view showing the worktable in its elevated position of operative association with the sewing machine's base.

The configuration of the base 19 is substantially cylindrical and its worksurface 22 is defined by its upper surface. The worktable 10 has a planar support surface 23 which is mounted on a vertically disposed structure that includes a lifting device identified generally by numeral 24 that is attached to a support bar 25 borne by the bench 11. This lifting device serves to vertically raise the support surface 23 to a position of operative association with the base 19 of the machine (FIG. 3).

The lifting device 24 is made, for example, from a conventional jacking apparatus which includes a vertically movable support shaft 26 connected to the underside of the support surface 23 and an electrical activator (not shown) that is disposed within a housing 27. The electrical activator is controlled by an actuating mechanism 28 having two push buttons 29 and 30 that are connected to a circuitry (not shown) contained within a housing 31, and are effective in causing the shaft 26 to be selectively raised or lowered to effect like movement of the support surface 23 therewith.

The support shaft 26 may also be pneumatically actuated rather than electrically in which case said shaft 26 would be moved by a cylinder into which fluid would be introduced by means of a conventional pedal pump (not shown) mounted on the base 12 adjacent to the pedal 18. The forward edge of the support surface 23 is provided with a recessed area 32 that serves to provide clearance for the operator's knees who is seated at the machine during operation thereof. This support surface 23 is operatively connected to the support shaft 26 by means of bolt members 33, the heads of which are located within guide tracks defining slotted openings 34 provided in said support surface. Support surface 23 also includes a recess 35, the sides of which extend parallel to the sides of the base 19 and with the open end thereof disposed in communication with the recessed area 32. This recess 35 has a configuration conforming to the general outline of the base 19 and when the support surface 23 is elevated to its maximum height, the sides and inner end of said recess are disposed in close proximity with said base 19 (FIG. 3) so as to substantially increase the workpiece supporting area.

Figure 2:
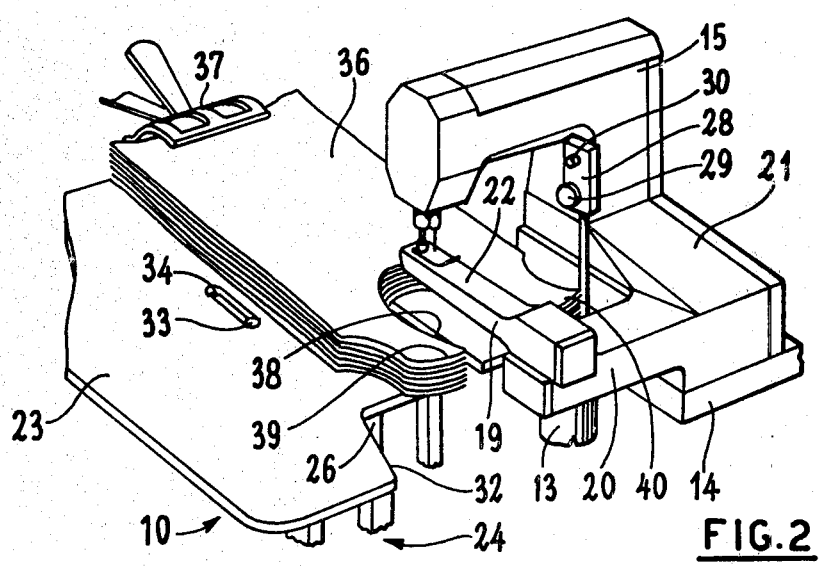
FIG. 2 is a perspective view similar to FIG. 1 with certain parts omitted and showing a plurality of superposed workpieces in position on the worktable.

Referring now to FIG. 2 which shows the worktable 10 being utilized for tubular seaming, the support surface 23 is adapted to have a plurality of superposed workpieces 36 positioned thereon and is located in a position lower than the base 19. The plurality of superposed workpieces are maintained in position on the support surface 23 by a conventional clamp member 37 so that they will not become displaced during independent manual manipulation of each article. The plurality of workpieces shown in FIG. 2 are knit pieces of fabric intended for men's garments in which the area to be sewn is that which covers the shoulders. These workpieces were pre-cut to form an arm-hole 38 located intermediate two sections 39 and 40 respectively which must be folded onto the worksurface 22 and then matched so that they can then be joined by a seaming operation.

After completion of the seaming operation, the article or workpiece is folded back over the clamp member 37 so that it can be removed from the machine and at the same time expose the next workpiece to be sewn. Before starting the next seaming operation, the operator actuates the push-button 29 which raises the support surface 23 and the workpieces 36 positioned thereon to whatever position said operator considers to be the most desirable. As the height of the plurality of superposed workpieces decrease and the distance between them and the base 19 increases, the operator again actuates the push button 29 in a manner to gradually adjust the distance between the base of the machine and the workpieces to be sewn.

Upon depletion of the plurality of superposed workpieces, the operator presses the push button 30 which serves to initiate the lowering of the support surface 23 and thus facilitate replenishment of another stack of superposed workpieces onto said support surface.

As shown in FIG. 3, the support surface 23 can be utilized when desired as an auxiliary worksurface for the worksurface 22 of the base 19. Such use may be required if the workpiece needs to be supported by a larger surface such as is required when sewing gusset linings into briefs. This auxiliary surface is provided by activating the lifting device 24 by means of the push button 29 which elevates the support surface 23 to a position where the sides of the recess 35 are disposed in close proximity with the sides of the base 19. As shown in FIGS. 1 and 2, the position of the heads of the bolts 33 in the slotted openings 34 are located in contact with the foward end of said slots which locates the support surface 23 in its rearmost position proper for tubular seaming and by means of the recessed area 32, adequate clearance for the knees of the operator seated at the machine.

After elevating the support surface 23, to provide the auxiliary surface for the worksurface 2, said support surface can be manually drawn forwardly a distance corresponding to the length of the slotted openings 34 which positions the heads of said bolts 33 in contact with the forward ends of said openings. Movement of the support surface 23 in this manner positions the end of the recess 35 in close proximity with the end of the base 19 and positions the worksurface closer to the housing 20. a sewing machine unit equipped with a worktable according to the invention can be quickly and easily converted to satisfactorily perform the two different forms of seaming as heretofore described by selectively pressing one or the other of the push buttons 29 and 30 to effect the required positioning of said worktable.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A worktable for a sewing unit of the type having a sewing machine with a free-arm type base mounted on a support bench, said worktable comprising:

(a) a support shaft (26) mounted for vertical movement on the support bench;

(b) a planar support surface (23) attached to the upper end of said support shaft;

(c) means operatively connected to said support shaft for selectively raising and lowering said support surface to and from operative association with the sewing machine base; and (d) means interconnecting said support shaft (26) and support surface (23) for selectively moving the latter a limited horizontal distance parallel with the longitudinal axis of the sewing machine base.

2. The structure according to claim 1 wherein said planar support surface (23) includes spaced and opposed vertically extending edges defining a recess (35) having a configuration conforming to the sewing machine base to effect positioning the sides thereof in close proximity with the sides of the sewing machine base when raised by said support shaft.

3. The structure according to claim 1 wherein said selectively moving means includes:

(a) a plurality of guide tracks defining slotted openings (34) in said support surface; and (b) a bolt member (33) operatively associated with each said slotted openings and connected to said support shaft for effecting movement of said support surface within the limits of the longitudinal length of said slotted penings.

* * * * *